US005446440A

United States Patent [19]

Gleason et al.

[11] Patent Number: 5,446,440

[45] Date of Patent: Aug. 29, 1995

[54] EMERGENCY SIGN AND CONTROL CIRCUIT

[75] Inventors: Cornel T. Gleason, San Antonio, Tex.; John L. Davis, Sierra Vista, Ariz.

[73] Assignee: Lederlite Corporation, San Antonio, Tex.

[21] Appl. No.: 1,582

[22] Filed: Jan. 6, 1993

[51] Int. Cl.[6] ..... G08B 27/00; G08B 5/00; F21V 7/00

[52] U.S. Cl. ..... 340/331; 340/332; 340/333; 340/691; 340/693; 340/815.42; 340/815.45; 340/815.69; 40/570; 362/31; 362/800

[58] Field of Search ..... 340/331, 908, 908.1, 340/691–693, 286.05, 791, 527, 521, 286.11, 815.42, 815.45, 815.69; 40/570; 362/31, 32, 800

[56] References Cited

U.S. PATENT DOCUMENTS

| | | | |
|---|---|---|---|
| 3,916,404 | 10/1975 | Gouge | 340/332 |
| 4,199,754 | 4/1980 | Johnson et al. | 340/332 |
| 4,283,657 | 8/1981 | Gordon et al. | 340/691 |
| 4,298,869 | 11/1981 | Okuno | 340/332 |
| 4,544,910 | 10/1985 | Hoberman | 340/333 |
| 4,682,147 | 7/1987 | Bowman | 340/286 |
| 4,929,936 | 5/1990 | Friedman et al. | 340/715 |
| 4,988,889 | 1/1991 | Oughton, Jr. | 340/333 |
| 5,018,290 | 5/1991 | Kozek et al. | 40/570 |
| 5,040,320 | 8/1991 | Reidinger | 40/570 |
| 5,105,568 | 4/1992 | Branning | 40/570 |
| 5,149,185 | 9/1992 | Mandy | 362/20 |
| 5,151,679 | 9/1992 | Dimmick | 340/331 |

*Primary Examiner*—John K. Peng
*Assistant Examiner*—Daniel J. Wu
*Attorney, Agent, or Firm*—Gunn, Lee & Miller

[57] ABSTRACT

A centrally powered, low voltage emergency sign and control circuit using high voltage AC power simultaneously providing continuous low voltage DC power to a plurality of emergency signs connected in parallel through a plurality of branch circuits and to continuously charge a single battery backup to all of the emergency signs should AC power fail. Each emergency sign is illuminated by electroluminescent diodes which are individually connected in parallel and in series throughout the emergency sign. When a fire alarm or emergency situation exists, the control circuit pulses the low voltage DC power to the emergency signs causing the LEDs to flash regardless if the control circuit is powered by high voltage AC power or backup battery power.

16 Claims, 4 Drawing Sheets

EMERGENCY SIGN AND CONTROL CIRCUIT

BACKGROUND OF THE INVENTION

1. Field of The Invention

This invention relates generally to emergency warning systems and, in particular, to a control circuit for supplying AC and DC power to a plurality of emergency signs with each sign having a plurality of series and parallel connected light sources.

2. Prior Art

All public buildings are required to have illuminated emergency exit signs indicating emergency evacuation routes. Uniform standards exist as to the exit signs' visibility, light intensity, lettering size, wording, and fail-safe operation. For example, emergency lighting systems must be designed and installed so that the exit sign is continuously illuminated and have an emergency backup power supply should the normal power supply fail.

Many buildings have numerous exits and a single multi-floor structure can contain literally thousands of exit signs. This many exit signs are expensive to install and consume thousands of kilowatts of electricity per year to operate and hundreds of man hours per year to maintain.

Most current exit signs are illuminated by a pair of 20 watt incandescent or fluorescent light bulbs. Since light bulbs burn out over time they must be replaced periodically. To replace the light bulbs a maintenance person must go to each exit sign, get out a step ladder to reach the exit sign, dismantle the exit sign, remove the burnt out bulb, install a new light bulb, reassemble the exit sign, remove the ladder, and discard the burnt out bulb. Just the cost of replacing these bulbs can become quite high.

Many types of the emergency exit signs are shown in the prior art including those that operate on high voltage AC power. Common high voltage systems use anywhere from 100 to 277 volts AC power. Most AC powered exit signs use a battery backup should AC power be lost. The batteries themselves must be regularly inspected and replaced. It has been estimated by those experienced in the art that each emergency exit sign costs between $70 and $120 per year to operate and maintain.

The use of high voltage AC power to energize incandescent or fluorescent light bulbs in emergency exit signs has an inherent problem. Light bulbs get hot during use. If a fire is detected the building's sprinkler system is energized and firemen use water to extinguish the fire. The water will contact the light bulbs causing many of them to break. Thus, when emergency exit signs are most needed they may not be available.

One attempted solution is described in Bowman, U.S. Pat. No. 4,682,147. Bowman's attempted solution is to use light emitting diodes in an exit sign which is powered directly from the building's AC power. The AC power charges a battery during normal operation and upon AC power failure switches to DC operation and pulses battery power to the light emitting diodes causing the exit sign to flash. Unfortunately, this arrangement flashes the exit sign whenever AC power is lost and not only when an emergency situation exists. Therefore, people may evacuate a building when the only problem was a short period of AC power loss. Also, maintenance costs are still substantial since each exit sign has its own battery which must be regularly inspected and replaced.

Other attempted solutions have red down lighting from the underside of the exit sign to assist people in seeing the evacuation route. Most painted warning signs along the evacuation route are written in red letters on white or yellow background so as to be easily readable in normal lighting. Some signs by law must use red, white, and yellow coloring, such as all radiation signs. However, in an emergency situation with AC power lost the normal lighting may not be available. The only light will be from the exit signs. Unfortunately, the red down lighting will wash out the red letters making the warning signs unreadable and exposing the people to unnecessary dangers.

It would thus be an improvement over the prior art of emergency exit signs and control circuits to provide a centrally powered, low voltage emergency sign and control circuit which consumes relatively little power, has a comparatively long life, has down lighting which allows red warning signs to be visible, eliminates bulb change out, reduces battery costs, allows central location maintenance, and flashes emergency signs only when the fire alarm is engaged.

SUMMARY OF THE INVENTION

It is an object of the present invention to provide an emergency sign which is highly visible and which can safely operate when sprayed with water from sprinkler heads or water hoses.

It is another object of the present invention to provide an emergency sign system with low operation and maintenance costs.

It is a further object of the present invention to provide a centrally powered emergency sign and control circuit system which uses low voltage AC power and battery back up for a plurality of exit signs.

It is another object of the present invention to provide an emergency sign system which flashes only when the fire alarm has been engaged.

It is a further object of the present invention to provide emergency signs which are illuminated by light sources individually connected in parallel and in series so that if one light source becomes inoperable all the other light sources will continue to operate.

It is a further object of the present invention to provide an emergency sign system with amber or down lighting for enhanced visibility of red warning signs during normal light failure.

It is another object of the present invention to provide an emergency sign and control circuit system for zone controlled fire alarm systems.

It is a further object of the present invention to provide an emergency sign and control circuit system which reduces solid waste.

The above objects are achieved in a centrally powered, low voltage emergency sign and control circuit which uses AC power to simultaneously provide continuous DC power to exit signs illuminated by electroluminescent diodes (LEDs) and charge a back up battery. An LED indicator on the front panel of the central power supply enclosure is illuminated when the AC power is supplied to the system. If an AC power failure occurs, back up battery power is supplied to the exit signs for approximately ninety minutes. The control circuit may accommodate up to six branches of exit signs. Each branch may have a plurality of exit signs connected in parallel for a total of 28 exit signs powered from the low voltage central power supply. When a fire alarm or emergency situation exist, the control circuit pulses the DC power to the exit signs causing the LEDs to flash regardless if the control circuit is powered by AC power or DC power. The present invention, thus, provides an improved emergency sign and control circuit having many features distinguishable over the prior art.

DETAILED DESCRIPTION OF THE PREFERRED EMBODIMENT

Figure 1:
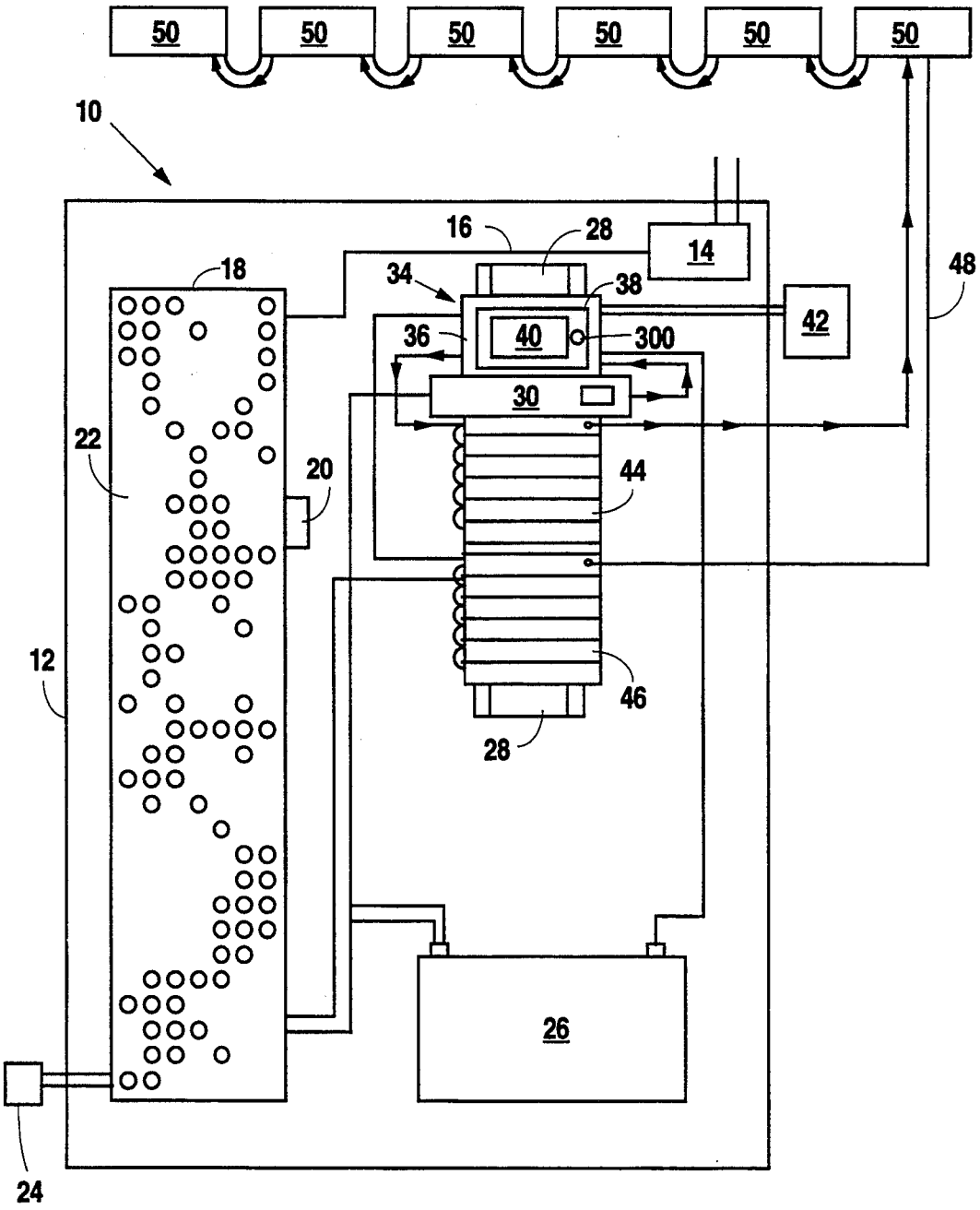
FIG. 1 is a block diagram of a centrally powered, low voltage emergency sign and control circuit of the present invention.

Reference is now made to FIG. 1 for a detailed description of one embodiment of the design of the present invention. Other embodiments are possible for a centrally powered, low voltage emergency sign and control circuit as the use of emergency signs change or as the output power requirements change. The invention disclosed in FIG. 1 comprises a number of identifiable functional parts which will be first generally described and interrelated with one another and then described in more specific detail. FIG. 1 also makes reference to several external parts which arc not explicitly described. These parts are not considered part of the disclosed embodiment of the invention, but will be described in sufficient detail to clarify the function of the invention and its interrelationship with these parts.

The centrally powered, low voltage emergency sign and control circuit 10 of FIG. 1 is composed generally of an enclosure 12, a test switch 14, a power supply unit 18, a back up battery 26, a fuse block 30, a relay flasher 34, a pair of terminal strips 44 and 46, a branch circuit 48, and an exit sign 50. There is also an external alarm system 42 connected to this invention.

The principle functions of the control circuit 10 are: to convert high voltage AC power into regulated low voltage DC power to centrally power several exit signs 50, to provide a central battery backup should AC power fail, to provide an external indication that AC power as failed, and to flash the illuminated exit signs should an alarm condition be present. The control circuit 10 is contained within enclosure 12 which is of sufficient size to contain all the parts and which can be made of any durable, strong material. In the preferred embodiment, enclosure 12 is made of fourteen gauge steel and is twelve inches long, eighteen inches high, and seven inches deep. Enclosure 12 has a front door (not shown) which can be fit with a keyed lock to limit access.

The following specific voltage, current, and resistance numbers should not be construed as maximum or minimum values but only as those values which are used in this preferred embodiment because other values could be used with simple electronic circuit calculations.

The control circuit 10 can be powered by any high voltage AC power commonly used in buildings and other structures. The AC power first enters enclosure 12 through test switch 14. Test switch 14 is a standard on/off switch which is used to test the system as later explained. The output of test switch 14 is carried by a power cord 16 to power supply unit 18.

Power supply unit 18 is an isolation type transformer power supply which converts the high voltage AC power into low voltage DC power. Any power supply unit 18 can be used which is able to receive different input volts from 60 volts AC to 554 volts AC, at anywhere from 40 Hertz to 90 Hertz, with input voltage fluctuations up to twenty-five percent, while maintaining a regulated DC power output. In the preferred embodiment, a power supply unit such a Power One's HEI5-9-A is used. This allows power supply unit 18 to receive any input of 100, 120, 220, 230, or 240 volts AC, at 47 through 63 Hertz, with input voltage fluctuations of 10–15 percent, while maintaining a regulated DC power output. The control circuit 10 can be designed for any DC power output from three to sixty volts DC; however, in the preferred embodiment the output is 13.8 volts DC.

Power supply unit 18 is modified for use in the present invention. One modification is to seal the power supply circuit board with conformal coating to protect it from shorts due to water vapor and moisture. Any type of UL listed conformal coating can be used although in the present invention a silicone based spray is used.

A second modification to power supply unit 18 is to add a perforated aluminum cover plate 22. Cover plate 22 is secured to the front of power supply unit 18 to minimize the chances of a person being accidentally shocked when power supply unit 18 is energized. Cover plate 22 is perforated to enhance air circulation to dissipate heat buildup.

A third modification is to individually fuse the power supply unit 18. A fuse 20 is added before the input current goes to the transformer of the power supply unit 18. Any fuse with a rating of one amp to twenty amps could be used; however, in the preferred embodiment a three amp fuse is used.

A fourth modification is to add an AC power indicator LED 24 to the power supply unit 18. The AC power indicator LED 24 is attached to the exterior of front door (not shown) of enclosure 12. AC power indicator LED 24 is powered directly from the transformer of power supply unit 18. Since the power coming directly off the transformer is AC, a diode and resistor (not shown) is placed in line to convert the AC power into half wave DC power and a resistor (not shown) is placed in line to limit the current to the LED. AC power indicator LED 24 is normally lit. When the AC power to power supply unit 18 fails LED 24 goes off, thereby providing external indication that a problem exists with the AC power supply.

In normal operation, the low voltage DC power output of power supply unit 18 is fed to fuse block 30 and terminal strip 44. The positive lead is secured to fuse block 30 and the negative lead is secured to negative terminal strip 46.

If AC power fails, backup DC power to illuminate exit signs 50 is provided through battery 26. Any rechargeable DC battery capable of illuminating the exit signs 50 for at least ninety minutes can be used. In the preferred embodiment, a gel cell, sealed rechargeable battery with 12 volt DC and 12 amps per hour rating is used. One such battery is from Power Sonic, Model PS-12120.

Battery 26 is constantly being recharged from the positive output lead of power supply unit 18 until AC power is interrupted. The negative terminal of battery 26 is connected to flasher relay 34. Once AC power is interrupted battery 26 immediately discharges and powers circuit 10 to illuminate exit signs 50. Once AC power is restored, battery 26 will stop powering circuit 10 and will again be recharged.

The positive output of power of supply unit 18 is connected to the input of fuse block 30 which is secured to metal rail 28. Fuse block 30 is a standard ten amp fuse block with an additional feature of an LED indicator light 32. LED indicator light 32 is normally off. Once the fuse is blown the light 32 will come on indicating that the ten amp fuse needs to be replaced. One such fuse block is manufactured by Wago, Model No. 282.

The positive input of relay flasher 34 receives the output of fuse block 30. Relay flasher 34 is composed of three separate elements: a terminal base 36, an isolated flashing cube 38, and an alarm relay 40. Terminal base 36 is secured to metal rail 28 and receives the input and output wires of relay flasher 34. One such terminal base which could work in the present invention is made by Releco, Model S2-B.

Flashing cube 38 is inserted into terminal base 36 and has an adjustable flashing rate. Flashing cube 38 is set at sixty flashes per minute, but can be adjusted by an adjustable thumb screw setting to (300) facilitate a stable and controlled flashing rate. The design of circuit 10 isolates relay current sensitivity to maintain even flash rate regardless of the load. One such flashing cube which could work in the present embodiment is Multicomat Type CT-2-B21-S.

A unique feature of the present invention is that flashing cube 38 is isolated from battery 26 and is operable in either normal mode or battery mode. The positive output of battery 26 is received by fuse block 30 and the negative output of battery 26 is received by flasher relay 34. In this configuration flashing cube 38 can flash the exit signs while the AC power is on and while battery 26 is being charged. Flashing cube 38 can also flash the exit signs when AC power has failed and circuit 10 is being powered by battery 26.

Alarm relay 40 plugs into flashing cube 38. Alarm relay receives an alarm input from any standard alarm system 42. The alarm system 42 can monitor any type of alarm condition. In the preferred embodiment, it will send a 24 volt signal when a fire condition is sensed either through automatic sensors or through a manual sensor. Many different alarm relays could be used, one such alarm relay is Releco Series MR-C.

The positive and negative outputs of relay flasher 34 is received by a pair of terminal strips such as Wago Model No. 262. Positive terminal strip 44 receives the positive output of relay flasher 34 and negative terminal strip 46 receives the negative output.

Terminal strips 44, 46 are capable of handling up to six different exit sign branches. Each branch 48 is comprised of a positive and negative output and can feed anywhere from one to fifty exit signs; however, in the preferred embodiment the maximum number of exit signs per branch is six and the total number of exit signs on all six branches is twenty-eight. Any type of electrical conducting wire with sufficient rating can be used. However, in the preferred embodiment twelve gauge, stranded wire is used. The length of branch 48 can vary from one foot to three thousand feet. However, in the preferred embodiment the maximum length is one thousand five hundred feet.

Figure 2:
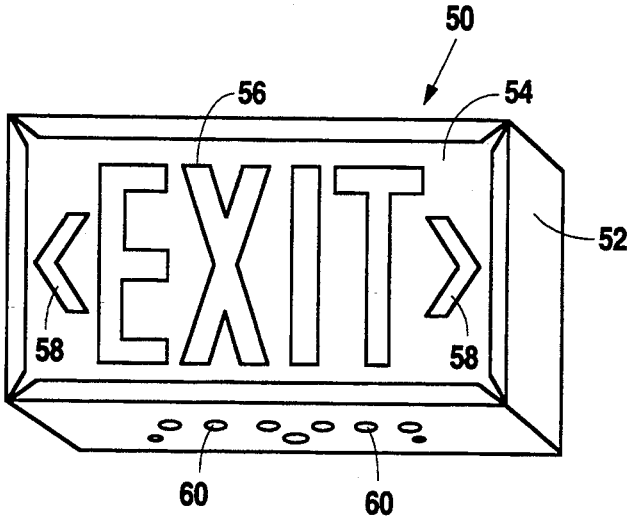
FIG. 2 is a perspective view of an emergency sign of the present invention.

In FIG. 2, an illuminated emergency sign is shown having a housing 52 and a display board 54 with the word "EXIT" marked thereon at 56 and chevrons 58 pointing in opposed directions. The word "EXIT" is illuminated by red light LEDs and a red filter panel is located between display board 54 and the LEDs to conceal each discreet LED and to provide a uniform red glow for the word "EXIT".

Down lighting 60 is provided on the bottom portion of housing 52 to provide light during emergency situations. Although down lighting 60 can be any color, in the preferred embodiment it is either amber or yellow lighting. This allows red warning signs to be clearly visible in emergency conditions. If red down lighting were used, as is used in many other exit signs, any warnings along the evacuation route marked in red letters would be invisible in emergency situations when normal lighting is extinguished.

The amber or yellow light LEDs are inserted in individual plastic lens. The lens keeps the LEDs from moving around and protects them from being broken. The lens have slots which correspond with a groove on the inside of enclosure 52 which keeps the exit sign circuit board aligned with panel 54 so that all LEDs shine through their respective letters and chevrons.

Figure 3:
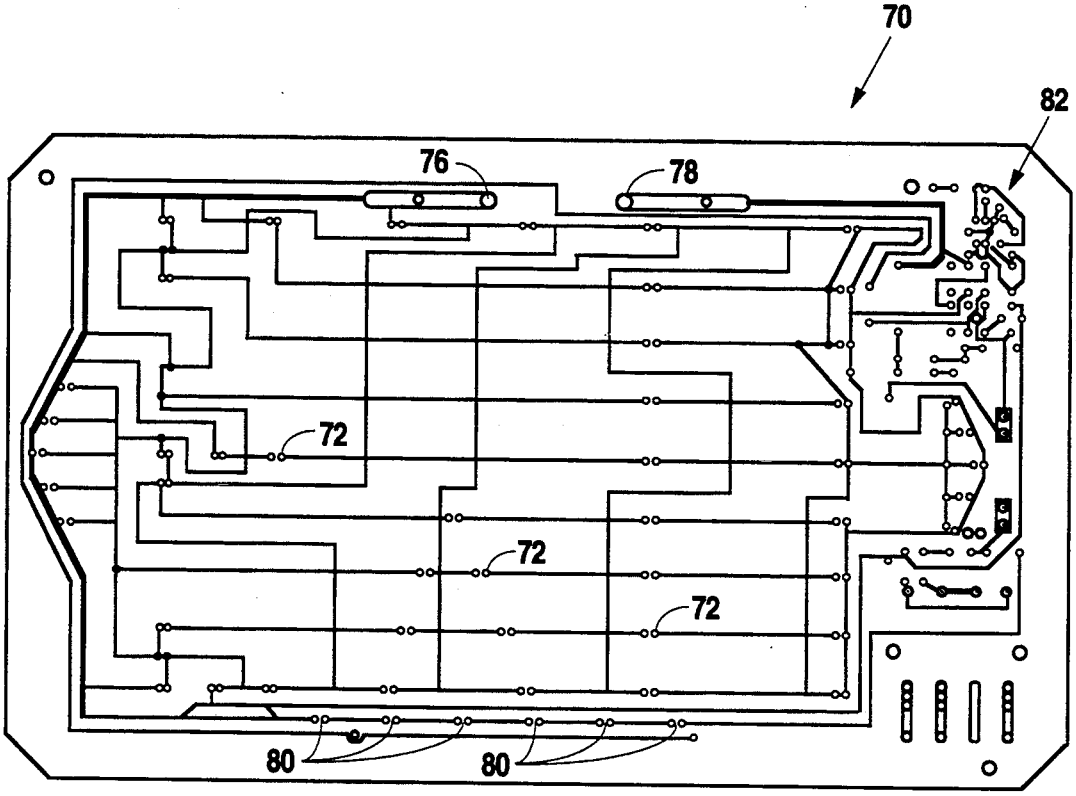
FIG. 3 is a front elevational view of the circuit board of the emergency sign of FIG. 2 including connections for light emitting diodes in both parallel and series.
Figure 4:
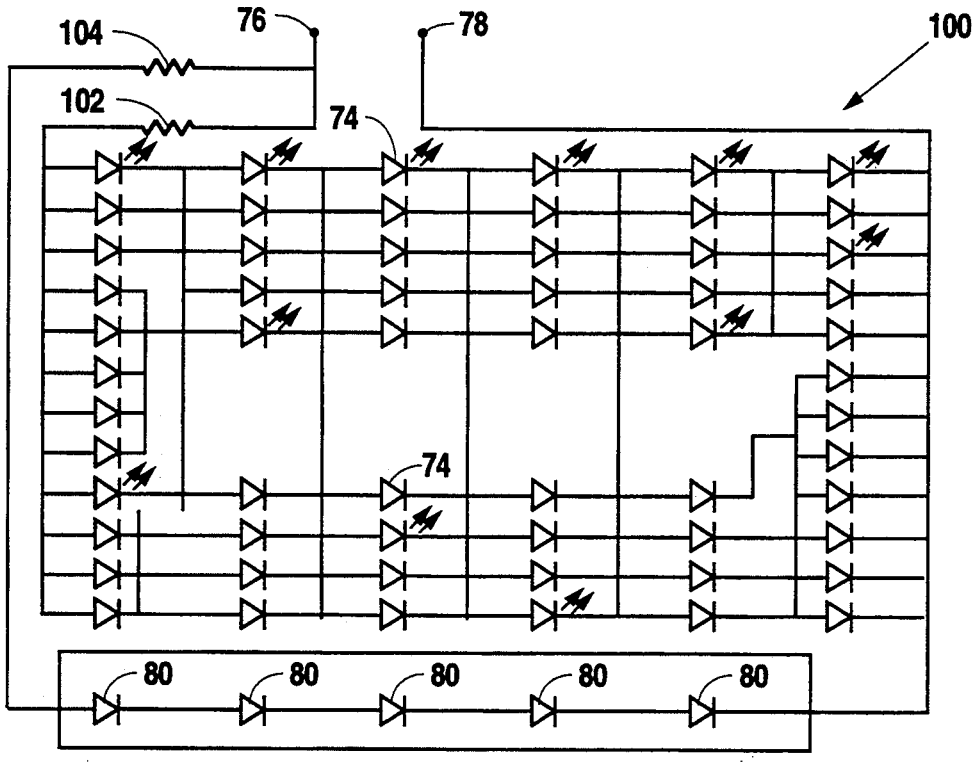
FIG. 4 is a circuit diagram of a circuit board for use in the emergency sign of FIG. 2.

FIG. 3 shows a front elevational view of the printed circuit board 70 of sign 50 having connections 72 for a plurality of light emitting diodes 74 (see FIG. 4). The connections 72 are arranged to spell the word "EXIT" 56 and to form chevrons 58. Red light LEDs 74 are used in the present invention to illuminate the word "EXIT" and the chevrons. Printed circuit board 70 includes first and second power connections 76, 78 to which voltage is applied to illuminate the LEDs 74 of exit sign 50. By examination of FIG. 3, it can be seen that the LED connections 72 are linked in parallel and in series throughout printed circuit board 70. This provides a unique benefit in that if one LED goes out then the rest of the LEDs remain evenly lit.

Examination of FIG. 3 also shows that the printed circuit board layout is a balanced design with conformal spacing and it requires no jumpers to get voltage to different points on the printed board 70. The balanced design allows maximized use of every LED as each individual LED shines through display board 54 to illuminate the word "EXIT" 56. This improves over the prior art which frequently had some LEDs which were used only to burn off excess voltage. Some prior art boards also use lit LEDs which did not shine through the display board to balance the light of the letters. The entire system is so efficient that even when all twenty-eight exit signs are being centrally powered at 120 volts the system uses less than one amp.

Another innovative aspect of printed circuit board 70 is that it can be used in various different embodiments of the present invention. In the preferred embodiment it is used in the centrally powered low voltage system. However, it is also used when each exit sign is individually hooked up to high voltage AC power with or without a fire alarm flasher and battery backup charger. Which of the various embodiments is being used is determined by how a control circuit 82 printed on the printed circuit board 70 is wired. The circuitry is best explained in accompanying FIGS. 4, 5 and 6.

FIG. 4 illustrates the printed circuit board 70 (not shown) being used for the preferred embodiment of a centrally powered, low voltage emergency sign and control circuit. Low voltage control circuit 100 includes first and second power connections 76, 78 to which voltage is applied to illuminate the LEDs 74 and 80. LEDs 74 are connected both in parallel and in series throughout control circuit 100. This provides a unique benefit in that if one LED 74 goes out then the rest of the LEDs 74 remain evenly lit. Down lighting LEDs 80 are connected only in series because they are encased in lens which greatly reduces the possibility of any of them being broken. Current limiting resistors 102 and 104 limit the current reaching LEDs 74, 80 to the required amount. When an alarm signal is indicated, flashing cube 38 pulses the current which reaches control circuit 100 thereby causing LEDs 74 to flash on and off.

In some uses of emergency signs only high voltage AC power may be desired to power each individual emergency sign without any alarm flashing or battery backup. As previously discussed, printed circuit board 70 can be used in different applications including one this one. Therefore, the LED circuit and placement is the same. The only difference is in control circuit 120 as disclosed in FIG. 5 which is an alternate embodiment of the present invention.

Control circuit 120 includes a transformer 124, a bridge rectifier 126, and a voltage regulator 128, as well as a variety of other circuit elements to insure proper operation. A power line 122, such as a 120 volt AC power line or a 277 volt AC power line, is connected across leads 130 and 132 of transformer 124 producing, in a preferred embodiment, approximately a 16 volt AC signal at outputs 134 and 136 of transformer 124. A full wave rectified signal appears at rectifier outputs 128 and 130. Output 130 is the positive voltage signal. The positive voltage signal is applied through a 39 ohm current limiting resistor 134 to down lighting LEDs 80.

The positive voltage signal of the rectifier is also applied through a 0.5 amp fuse 132 and filtered through a 470 microfarad capacitor 138 to produce an essentially DC signal. The DC signal is fed to an LM317 voltage regulator 128. Voltage regulator 128 produces a consistent and stable 11.8 volts regardless of the voltage applied to transformer 124. Different voltages can occur during fire fighting situations as equipment shorts out and breakers pop. Resistor 140 is a 2400 ohm resistor back to ground. Resistors 142 and 144 allow for adjustment of the voltage regulator output. The voltage regulator 128 is designed to have a 3 volt drop between input and output with a 1.2 volt difference between resistors 142 and 144. Thus, the 11.8 volts DC power will be consistent as long as at least 14.8 volts is applied to the voltage regulator. The 11.8 volt DC power is applied to illuminate LEDs 72.

Figure 6:
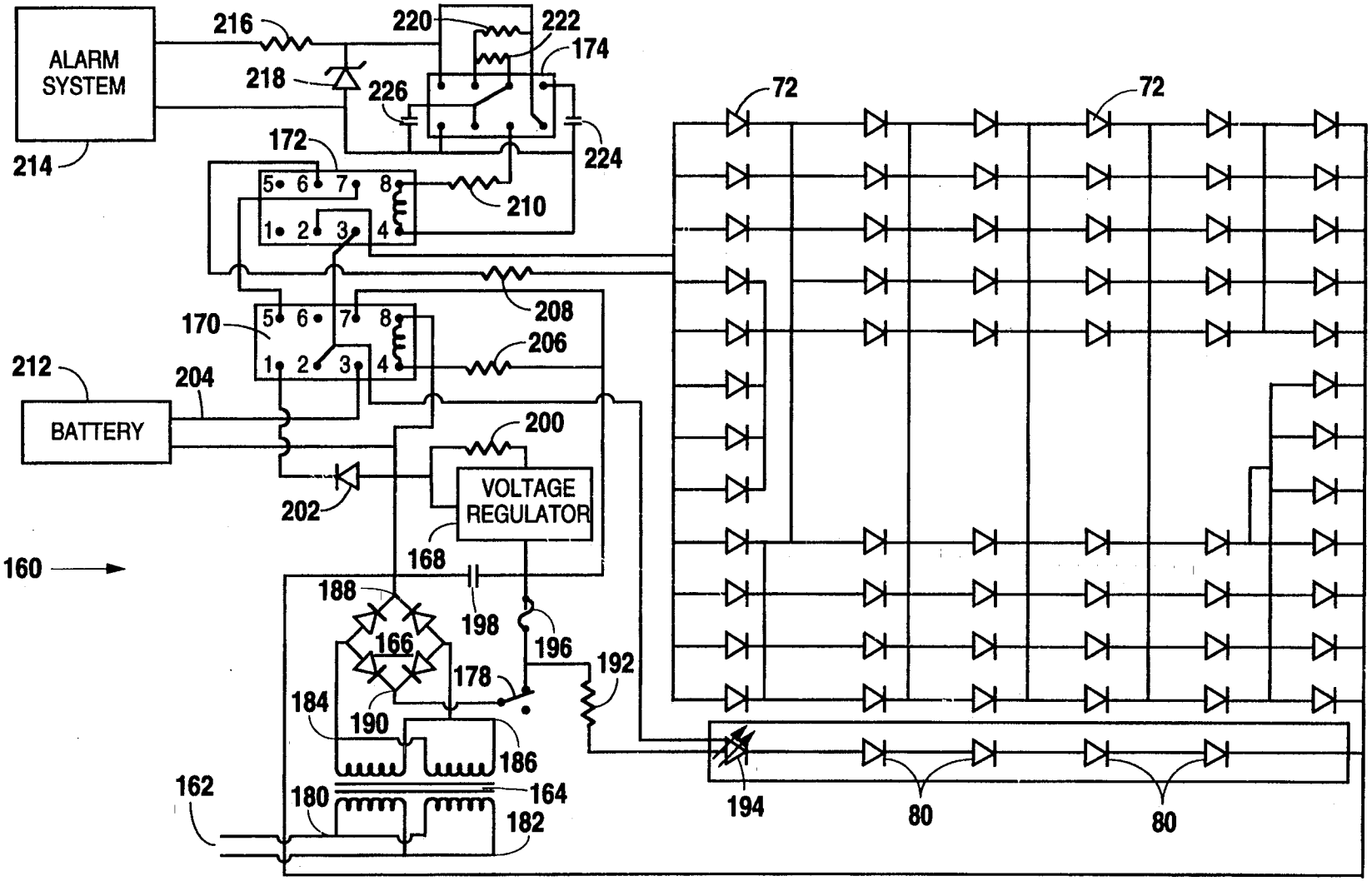
FIG. 6 is a circuit diagram of a circuit board for use in a second alternate embodiment of FIG. 2.

FIG. 6 illustrates a high voltage emergency sign with alarm flashing and battery back up capabilities. Control circuit 160 includes a transformer 164, a bridge rectifier 166, a voltage regulator 168, a pair of relays 170 and 172, a timer 174, and a test switch 178, as well as a variety of other circuit elements to insure proper operation. A power line 162, such as a 120 volt AC power line or a 277 volt AC power line, is connected across leads 180 and 182 of transformer 164 producing, in a preferred embodiment, approximately a 16 volt AC signal at outputs 184 and 186 of transformer 164.

A full wave rectified signal appears at rectifier outputs 188 and 190. Output 190 is the positive voltage signal. The positive voltage signal is applied through a spring biased test switch 178 and through a 39 ohm current limiting resistor 192 to a dual light down lighting LED 194 and several single light down lighting LEDs 80.

The positive voltage signal of the rectifier 166 is also applied through a 0.5 amp fuse 196 and filtered through a 470 microfarad capacitor 198 to produce an essentially DC signal. The DC signal is fed to an LM317 voltage regulator 168. Voltage regulator 168 produces a consistent and stable 11.8 volts through a range of 90 to 130 volts applied to transformer 164, as discussed above in FIG. 5.

Relays 170 and 172 are identical in operation. If the coil between pin 4 and pin 8 is energized, then pin 1 and pin 3 are latched together as are pin 5 and pin 7. If the coil between pin 4 and pin 8 is not energized, then pin 2 and pin 3 are latched together as are pin 6 and pin 7. Each coil has a 220 ohm resistor 206 and 210, respectively, to limit the current used to operate the coils and save energy. The reduced current also reduces the heat generated by the coil extending the life of each coil to at least several years of continuous flashing.

Figure 5:
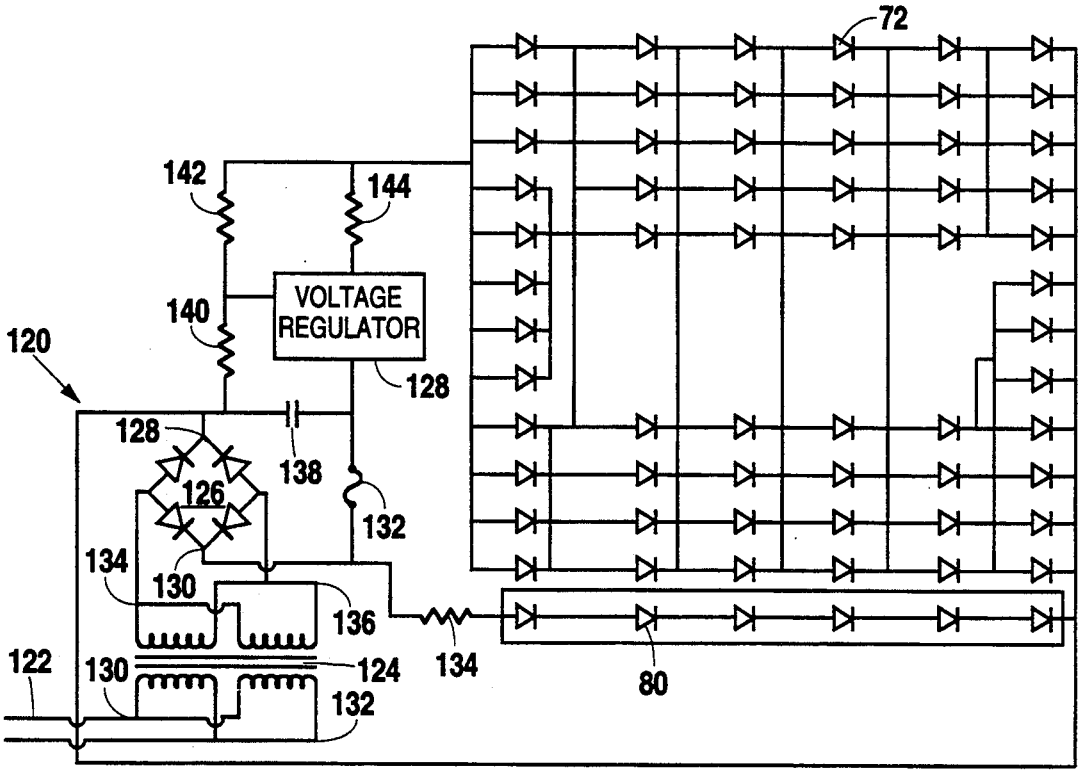
FIG. 5 is a circuit diagram of a circuit board for use in a first alternate embodiment of FIG. 2.

Voltage regulator 168 is the same chip as used in FIG. 5, however in this embodiment the circuit is current limiting through resistor 200 which keeps a battery 212 from being overcharged. A diode 202 is placed in-line to prevent the battery from discharging through the voltage regulator's adjust when the circuit is being battery powered.

In normal AC power operation, test switch 178 is closed feeding positive voltage output from rectifier 166 to voltage regulator 168 and pin 4 and pin 7 of relay 170. Negative voltage output is fed to pin 8 of relay 170 from rectifier 166. Since the coil of relay 170 is energized, pin 1 receives the output of voltage regulator 168 and it exits relay 170 through pin 3 to charge the battery 212. The positive voltage output of rectifier 166 is received by relay 170 through pin 7 and it exits by pin 5 to power relay 172.

Relay 172 receives power through pin 7. The coil between pin 4 and pin 8 is not energized, therefore the positive voltage output exits relay 172 through pin 6. The current is fed through a 39 ohm power limiting resistor 208 and illuminates diodes 72.

To test the battery backup, a maintenance person can either turn off the AC power or press test switch 178. The test switch 178 is spring biased to normal operation so that once the person releases the switch the circuit reverts back to normal operation. In normal operation, diode 194 is powered through resistor 192 and emits a green light to indicate normal operation. However, diode 194 has two separate crystals, one for green light and one for red light. The red light is lit when the battery 212 is discharging confirming that the battery backup is properly working.

When the test switch 178 is depressed, voltage regulator 168 and pin 4 of relay 170 do not receive the positive voltage output of rectifier 166. Thus, pin I of relay 170 does not receive any power and the coil of relay 170 is not energized. Therefore, battery 212 immediately begins to discharge sending a positive charge to pin 3 of relay 170. This charge exits relay 170 through pin 2 and part goes to illuminate the red crystal of diode 194 and the other part is received by pin 3 of relay 172. Since the coil of relay 172 is not energized the current exits relay 172 through pin 2 and illuminates diodes 72 without going through any current limiting resistors. There is no reason to add a resistor to the battery circuit since the system is already on a limited amount of time depending on how long the battery lasts.

If the alarm system 214 perceives an emergency condition, diodes 72 should flash to notify occupants to exit the building. The flasher circuitry operates by energizing the coil of relay 172. When the coil is energized it latches pin 3 and pin 7 with pin 1 and pin 6, respectively. However, pin 1 and pin 6 are not connected to anything and diodes 72 are not illuminated. Once the coil is not energized, the diodes 72 are again illuminated creating the flashing affect. This works for either normal AC power operation or battery backup operation.

Alarm system 214 sends a 24 volt DC signal whenever is senses an emergency condition. A 555 timer 174 rated for a maximum of 16 volts operation is used to flash the LEDs. To reduce the input voltage, the signal is fed through a 300 ohm current limiting sensor 216 and then between the signals positive and negative leads a 15 volt zener diode 218 ensures that timer 174 receives a maximum of 15 volts. A pair of 1 microfarad capacitors 224, 226 are located in the circuit. Varying the value of resistors 220 and 222 will then control the flashing rate and duty cycle. Although any rate between 30 to 120 flashes per minute and at least 300 millisecond off time can be used, in the preferred embodiment, resistor 220 is a 680 k ohm resistor and resistor 222 is a 330 k ohm resistor to flash the diodes 72 sixty flashes per minute with approximately a 500 millisecond off time and a fifty percent duty cycle.

The embodiment of FIG. 6 discloses an alarm system which must be hard wired to the flashing cube to transmit the 24 volt DC alarm signal. However, it is contemplated that the alarm signal can be transmitted to the flashing cube in several other ways such as a high frequency modulated signal on the primary AC voltage supply of a building or even an infrared signal. There is no limitation to the many different ways the alarm signal reaches the flashing cube.

Although the invention has been described with reference to specific embodiments, this description is not meant to be construed in a limiting sense. Various modifications of the disclosed embodiments, as well as alternative embodiments of the invention, will become apparent to persons skilled in the art upon reference to the description of the present invention. For example, the down lighting diodes 80 could be voltage regulated by disconnecting the current reducing resistor 134 from the output of rectifier 126, connecting it to the output of voltage regulator 128, and changing the value of the resistor. This way both the exit sign letters and down lighting would be voltage regulated. It is therefore contemplated that the following claims will cover such modifications that fall within the true scope of the invention.

I claim:

1. An emergency sign and control system comprising:

a test switch connected to high voltage AC power;

an isolation type transformer power supply unit connected to said test switch for converting said high voltage AC power into low voltage DC power output;

said power supply unit further comprising, a front face and a rear face;

a conformal coating sealing the power supply circuit board of said power supply unit to protect said power supply circuit board from water vapor and moisture;

a perforated aluminum cover plate attached to said front face of said power supply;

a fuse connected for disconnecting said power supply unit from said high voltage AC power; and an AC power indicator circuit comprising an indicator light emitting diode, a diode/resistor pair connected in series to said power supply unit to convert the received AC power into half wave DC power, and a current limiting resistor connected in series to said diode/resistor pair to limit current reaching said indicator diode whereby, said indicator diode is normally lit and goes off if there is a problem with said AC power to said power supply;

a fuse block having an input and an output, said input of said fuse block connected to said power supply unit for receiving said low voltage DC power and conveying it to a relay flasher;

at least two terminal strips connected to said relay flasher for conveying said low voltage DC power to a branch circuit;

an enclosure which encases said power supply unit, said fuse block, said relay flasher, and said terminal strips;

a plurality of emergency signs connected in parallel along said branch circuit;

a plurality of light emitting diodes arranged on said emergency signs to form an illuminated message on said emergency sign;

means connected to said relay flasher for providing battery backup to said emergency signs should AC power fail; and a plurality of light emitting diodes arranged on said emergency signs to provide downlighting from said emergency signs.

2. An emergency sign and control system of claim 1 wherein said relay flasher comprises:

a terminal base connected to said output of said fuse block;

an isolated flashing cube connected to said terminal base; and an alarm relay connected to said flashing cube for receiving an alarm input from an alarm system whereby said emergency signs can flash whenever an alarm condition exists regardless if said emergency signs are energized by AC power or battery power.

3. An emergency sign and control system of claim 2 wherein said flashing cube has an adjustable thumb screw to facilitate a stable and controlled flash rate.

4. A centrally powered control device using high voltage AC to power low voltage emergency signs which will flash said emergency signs when an alarm system indicates an alarm condition is present comprising:

an enclosure;

a normally closed, test switch connected to said high voltage AC power mounted within said enclosure;

a power supply unit connected to said test switch converting said high voltage AC power into low voltage DC power, said power supply mounted within said enclosure, said power supply comprising:

a power supply housing;

a first input connected to an output of said test switch;

a first output;

a fuse mounted within said housing for disconnecting said power supply unit from said high voltage AC power;

an isolation type, transformer mounted within said housing connected to said fuse;

a circuit board mounted within said housing;

a conformal coating scaling said board to protect said board from water vapor and moisture;

a perforated aluminum cover plate attached to the front of said housing; and means for indicating AC power to said power supply unit comprising an indicator light emitting diode attached to the exterior of said enclosure, a diode/resistor pair connected in series to said AC power to convert said AC power into half wave DC power, and a current limiting resistor connected in series to said diode/resistor pair to limit the amount of current reaching said AC indicator means;

a fuse block connected to said first output of said power supply unit mounted within said enclosure, said fuse block having an output;

a relay flasher connected to said output of said fuse block, said relay flasher comprising:

a terminal base connected to the output of said fuse block;

an isolated flashing cube connected to said terminal base, said flashing cube having an adjustable thumb screw to facilitate a stable and controlled flash rate; and an alarm relay connected to said flashing cube for receiving an alarm input from said alarm system;

a terminal strip connected to said relay flasher for conducting said low voltage DC power to a branch circuit;

a backup battery connected to said relay flasher to power said relay flasher if said power supply unit fails to provide sufficient low voltage DC power, said backup battery being a gel cell, sealed rechargeable battery having a positive and a negative terminal, said backup battery being continuously charged from a positive lead of said power supply unit, said negative terminal of said battery connected to said flasher relay;

a plurality of emergency signs connected in parallel along said branch circuit, said emergency signs comprising:

first and second DC power inputs;

a plurality of light emitting diodes connected to said DC power inputs, said diodes being colored light diodes connected in parallel and in series to each other;

a plurality of downlighting light emitting diodes connected to said DC power inputs, said downlighting diodes being amber light diodes connected in series to each other, said downlighting diodes encased in a plurality of lens;

a first current limiting resistor connected between said DC power inputs and said diodes to limit the amount of current reaching said diodes;

a second current limiting resistor connected between said DC power inputs and said downlighting diodes to limit the amount of current reaching said down lighting diodes;

whereby said emergency signs flash whenever an alarm condition exists regardless if said relay flasher is powered by AC power or backup battery power.

5. An emergency sign and control system of claim 4 further comprising a plurality of branch circuits connected to said terminal strips and a plurality of emergency signs connected to each said branch circuit.

6. An emergency sign and control system of claim 4 further comprising six branch circuits connected to said terminal strips and up to thirty six emergency signs connected to said branch circuits.

7. The apparatus of claim 4 wherein said colored light diodes are red.

8. The apparatus of claim 4 wherein said colored light diodes are green.

9. An emergency sign having a low voltage control circuit which when an alarm condition is present a flasher unit will cause the emergency sign to flash comprising:

a housing;

at least one display board mounted within said housing;

a plurality of light emitting diodes arranged on said display board to form a perceived message, said light emitting diodes connected in a parallel and series circuit, said light emitting diodes connected in parallel and series to each other;

said parallel and series circuit drawing substantially the same amount of current and with conformal spacing;

first and second AC power inputs connected across said parallel and series circuit for supplying power to said light emitting diodes;

a plurality of downlighting light emitting diodes connected to said power inputs, said downlighting diodes connected in a series circuit to each other, said downlighting diodes encased in a plurality of lens;

a first current limiting resistor connected between said power inputs and said light emitting diodes to limit the amount of current reaching said light emitting diodes; and a second current limiting resistor connected between said power inputs and said downlighting light emitting diodes to limit the amount of current reaching said downlighting light emitting diodes whereby when an alarm condition is present said flasher unit pulses the current reaching said power inputs causing said light emitting diodes and said downlighting diodes to flash.

10. An emergency sign having a high voltage control circuit comprising:

a housing;

at least one display board mounted within said housing;

first and second AC inputs located on said display board;

a transformer connected to said first and second AC inputs, said transformer transforming said high voltage AC input into a circuit low voltage AC signal;

a bridge rectifier having a positive input, a negative input, a positive output, and a negative output, said bridge rectifier connected to outputs of said transformer to rectify said circuit low voltage AC signal;

a downlighting circuit comprising a first current limiting resistor connected to said positive output of said bridge rectifier and a plurality of downlighting light emitting diodes connected in series to said first current limiting resistor, said downlighting diodes encased in a plurality of lens;

a filter circuit comprising a filtering capacitor and a fuse connected in parallel to each other for producing a DC signal, said capacitor connected to said negative output of said rectifier and said fuse connected to said positive output of said rectifier;

a voltage regulator circuit comprising a voltage regulator and at least two output resistors, said voltage regulator connected in series to said filtering circuit to receive said DC signal and to produce a consistent and stable DC signal, said output resistors connected in parallel to each other and connected to said output of said voltage;

a plurality of light emitting diodes arranged on said display board to form a perceived message and connected to said voltage regulator circuit for supplying power to said light emitting diodes, said light emitting diodes connected in a parallel and series circuit, said light emitting diodes connected in parallel and series to each other; and said parallel and series circuit drawing substantially the same amount of current and with conformal spacing.

11. The invention of claim 10 further comprising:

a plurality of downlighting light emitting diodes connected to said voltage regulator circuit for supplying power to said downlighting light emitting diodes, said downlighting light emitting diodes connected in a series circuit to each other; and said downlighting light emitting diodes encased in a plurality of lens.

12. An emergency sign having a high voltage control circuit of claim 11 further comprising:

a normally closed, spring biased test switch for disconnecting said rectifier from said filter circuit and said downlighting circuit;

said plurality of downlighting diodes of said downlighting circuit comprising a dual light diode and at least one other diode, said dual light diode indicating when said test switch is open;

said voltage regulator circuit comprising a current limiting resistor and a diode connected in series to each other, and a voltage regulator; said voltage regulator circuit connected in series to said filtering circuit to receive said DC signal and to produce a consistent and stable DC signal;

a battery;

means for preventing said battery from discharging through said voltage regulator and means for preventing said battery from being overcharged;

first and second alarm inputs;

a timer circuit connected to said first and second alarm inputs and a relay circuit, said timer circuit adapted to flash said light emitting diodes whenever said alarm inputs indicate an emergency condition; and said relay circuit comprising a pair of relays connected to said voltage regulator, said battery, and said timer circuit; said relay circuit arranged so as to have a normal operation mode, a battery mode, and an emergency condition mode, said normal operation mode having said voltage regulator powering said light emitting diodes and said downlighting circuit, said battery mode having said battery powering said light emitting diodes and said downlighting circuit, and said emergency condition flashing said light emitting diodes.

13. The invention of claim 12 wherein said bridge rectifier is a full wave bridge rectifier.

14. The invention of claim 12 wherein said transformer is an isolation type transformer.

15. The invention of claim 12 further comprising an LED indicator which is illuminated when AC power is supplied to said relay circuit during said emergency condition mode.

16. The invention of claim 12 further comprising at least two branches of emergency control circuits, said branches having a plurality of exit signs connected in parallel.

* * * * *